United States Patent [19]

Wasemann

[11] Patent Number: 4,904,166

[45] Date of Patent: Feb. 27, 1990

[54] VERTICAL AXIS MOTOR-PUMP ASSEMBLY FOR CLOTHES WASHING MACHINE

[75] Inventor: William A. Wasemann, Mansfield, Ohio

[73] Assignee: White Consolidated Industries, Inc., Mansfield, Ohio

[21] Appl. No.: 277,991

[22] Filed: Nov. 30, 1988

[51] Int. Cl.[4] ..... F04B 39/14

[52] U.S. Cl. ..... 417/360; 417/423.11; 417/424.2

[58] Field of Search ..... 417/360, 423.9, 423.11, 417/423.14, 423.15, 424.1, 424.2; 415/168.1, 168.2

[56] References Cited

U.S. PATENT DOCUMENTS

| | | | |
|---|---|---|---|
| 3,179,058 | 4/1965 | Meagher | 417/360 |
| 3,199,745 | 8/1965 | Hollis et al. | 417/360 X |
| 3,549,277 | 12/1970 | De Kiss et al. | 415/168.2 X |
| 4,306,841 | 12/1981 | Morrison et al. | 417/360 |
| 4,466,780 | 8/1984 | Naurath | 417/360 |
| 4,569,638 | 2/1986 | Harker et al. | 417/423.11 X |
| 4,810,174 | 3/1989 | Stuckey et al. | 417/423.14 |
| 4,836,753 | 6/1989 | Berfield et al. | 417/360 X |

*Primary Examiner*—Leonard E. Smith
*Assistant Examiner*—Eugene L. Szczecina, Jr.
*Attorney, Agent, or Firm*—Pearne, Gordon, McCoy & Granger

[57] ABSTRACT

A motor-pump assembly for an agitator-type clothes washing machine includes a motor with a vertical drive shaft having upper and lower ends that extend above and below the top and bottom end bells of the motor casing. The lower end of the drive shaft carries a pulley for rotating the input shaft of a belt driven transmission actuating an associated agitator and spin tub. The upper end of the drive shaft carries a water pump impeller contained within a pump casing that rests on a dishlike drip shield, the shield in turn resting on the top end bell of the motor casing. The pump casing, the drip shield, and the top end bell of the motor casing are maintained in vertical alignment with each other by a pair of springlike metal clips that can be easily removed to allow for pump replacement.

9 Claims, 4 Drawing Sheets

VERTICAL AXIS MOTOR-PUMP ASSEMBLY FOR CLOTHES WASHING MACHINE

BACKGROUND OF THE INVENTION

The present invention relates in general to motor-pump assemblies, and more particularly to a vertical axis motor-pump assembly for an agitator-type clothes washing machine.

It is known to provide an agitator-type clothes washing machine with a motor having a vertical drive shaft with upper and lower ends that extend above and below the top and bottom end bells of the motor casing. The lower end of the drive shaft carries a pulley for rotating the input shaft of a belt driven transmission actuating an associated agitator and spin tub. The upper end of the drive shaft has fixed to it an impeller located within a water pump casing positioned above the motor, the water pump casing having two halves that fit together to define a pump chamber containing the pump impeller. A dishlike drip shield is positioned underneath the pump so as to be located between the pump and the motor so that any water leaking downwardly from the pump is diverted away from the motor. Appropriate fasteners, such as a plurality of self-tapping screws, hold the two pump casing halves together, hold the pump casing in position on the drip shield, and hold the drip shield in position on the top end bell of the motor.

In order to service the pump, all or most of the above-noted screws must be removed, and then the pump casing halves must be separated to permit access to the pump impeller which is fixed to the upper distal end of the motor drive shaft. The impeller can then be removed and repaired or replaced wherein the pump must be reassembled, and then reinstalled in its position on the drip shield.

It would be desirable to provide a simpler, more readily serviceable motor-pump assembly that would include a disposable or "throw-away" water pump.

Such "throw-away" type motor-pump assemblies are known in the art as illustrated by U.S. Pat. No. 4,306,841. The '841 patent illustrates a horizontal axis motor-pump assembly for an agitator-type clothes washing machine, the assembly including a disposable pump held in position on the end of the motor drive shaft, and on the end bell of the associated motor, by a pair of metal spring clips. Because the motor-pump assembly is of the horizontal axis type, any water leaking from the pump will not drip onto the motor, therefore no drip shield is needed.

It is a purpose of the present invention to provide a vertical axis motor-pump assembly having a disposable or "throw-away" pump wherein a drip shield is provided to preclude water leakage onto the underlying motor. Such a motor-pump assembly should be easy to disassemble and reassemble so as to facilitate removal and replacement of the disposable water pump.

SUMMARY OF THE INVENTION

The motor-pump assembly in accordance with the present invention includes a motor having a casing with a top end bell and a bottom end bell, the motor including a generally vertical drive shaft rotatably supported by the end bells, the upper end of the shaft extending above the top end bell.

A dishlike drip shield has a plurality of downwardly extending leg portions with distal ends that engage the top end bell wherein the end bell supports the drip shield. The drip shield includes a generally centrally located aperture through which the upper end of the drive shaft freely extends.

A water pump is positioned above the drip shield, the pump having a pump casing defining a chamber enclosing a rotatable impeller which is carried on the upper distal end of the drive shaft. The pump casing includes another plurality of downwardly extending leg portions with distal ends that engage the drip shield, the drip shield supporting the pump casing. The drip shield serves to divert water away from the underlying motor should any water leak downwardly from the pup.

A means for applying a biasing force to the pump casing, in the preferred form of a pair of resilient spring-like clips, holds the pump in position against the drip shield, the biased pump casing in turn applying the biasing force against the drip shield to hold it in position against the top end bell of the motor. In effect, the drip shield is sandwiched between the pump casing and the top end bell of the motor, and is held in such position by the biasing force of the spring clips.

Preferably the leg portions of the drip shield and the leg portions of the pump casing are vertically aligned with each other, the bottom distal ends of the leg portions of the drip shield plugging into apertures functioning as locator points provided by the top end bell of the motor. The lower distal ends of the leg portions of the pump casing in turn are inserted into recesses in the drip shield, such recesses also functioning as a plurality of locator points.

In accordance with the invention, the spring clips, functioning as the biasing means, can be manually removed wherein the pump and drip shield can be easily separated from the motor and from each other wherein a defective pump can be discarded and replaced with a new pump.

The motor-pump assembly in accordance with the present invention has been found to be low in manufacturing costs and readily providing for easy repair and maintenance.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
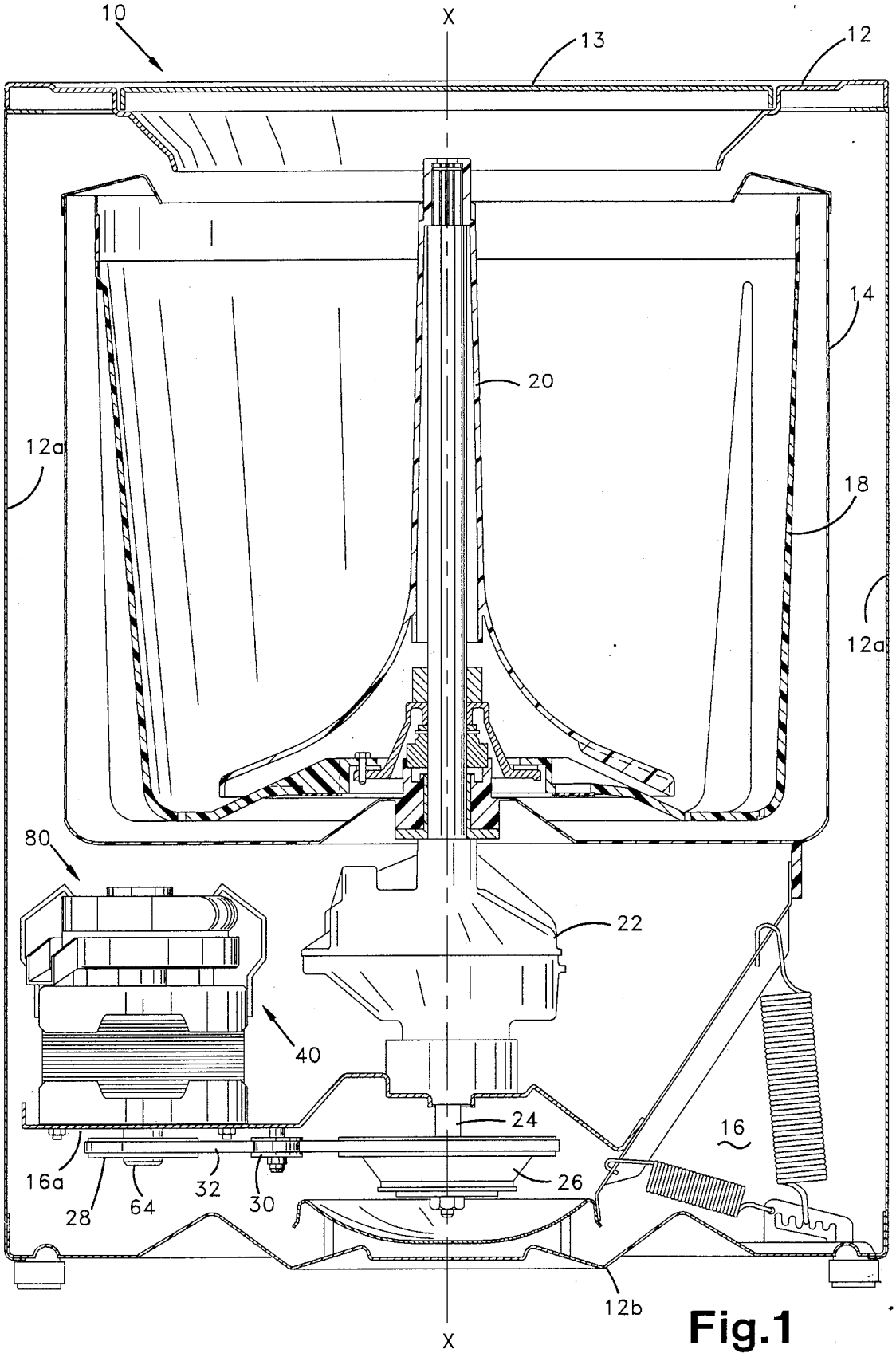
FIG. 1 is a vertical cross section view of an agitator-type clothes washing machine with parts removed for illustration purposes.

With reference to FIG. 1, an agitator-type clothes washing machine 10 is illustrated. The washing machine 10 includes as major components thereof a boxlike cabinet 12 formed of a plurality of sheet metal panels which form four vertically extending sidewalls 12*a* (only two shown) and a bottom or floor panel 12*b*. The top end of the cabinet 12 includes a hinged lid 13 that can be raised to provide user access to the interior of the clothes washing machine 10.

Inside the cabinet 12, an imperforate outer tub 14 for containing wash and rinse water is supported by a resilient support system 16 comprised, for example, of a plurality of spring, struts, etc. wherein the outer tub 14 rests upon and is resiliently supported by the bottom or floor panel 12*b* of the cabinet 12. Rotatably supported and contained within the outer tub 14 is a perforated spin tub 18 within which, in turn, is centrally located a center post agitator structure 20. As well known in the art, the outer tub 14 holds wash or rinse water, while the spin tub 18 contains clothes to be washed or rinsed by the oscillating action of the agitator 20. At the end of a wash or rinse cycle, the tub 18 is spun about a vertical axis x—x, as illustrated, to centrifuge retained water out of the clothing contained therein.

Oscillating, agitating movement of the agitator 20, and water extracting spinning of the tub 18, are provided by a belt driven transmission 22 which extends below the outer tub 14. The belt driven transmission 22 includes at its lower end a transmission input shaft 24 which has fixed to it a driven pulley 26. Rotation of the shaft 24 via pulleys 26 causes either spinning of the tub 18 or oscillating motion of the agitator 20, depending upon the direction of rotation of the shaft 24, as is well known in the art. An adjacent idler pulley 30 provides proper tensioning of a drive belt 32 which is driven by a drive pulley 28. It is to be understood that the clothes washing machine elements discussed thus far are conventional as to structure and arrangement, and are well within the knowledge of those skilled in the art.

With further reference to FIG. 1, a motor-pump assembly 40 in accordance with the present invention is illustrated. The motor-pump assembly 40 rests upon and is mounted to a frame member 16*a* constituting a portion of the resilient support system 16 discussed earlier. The motor-pump assembly 40 functions to rotate the drive pulley 28 and to drive a water pump 80 in a manner to be more fully illustrated with reference to FIGS. 2 through 5.

Figure 2:
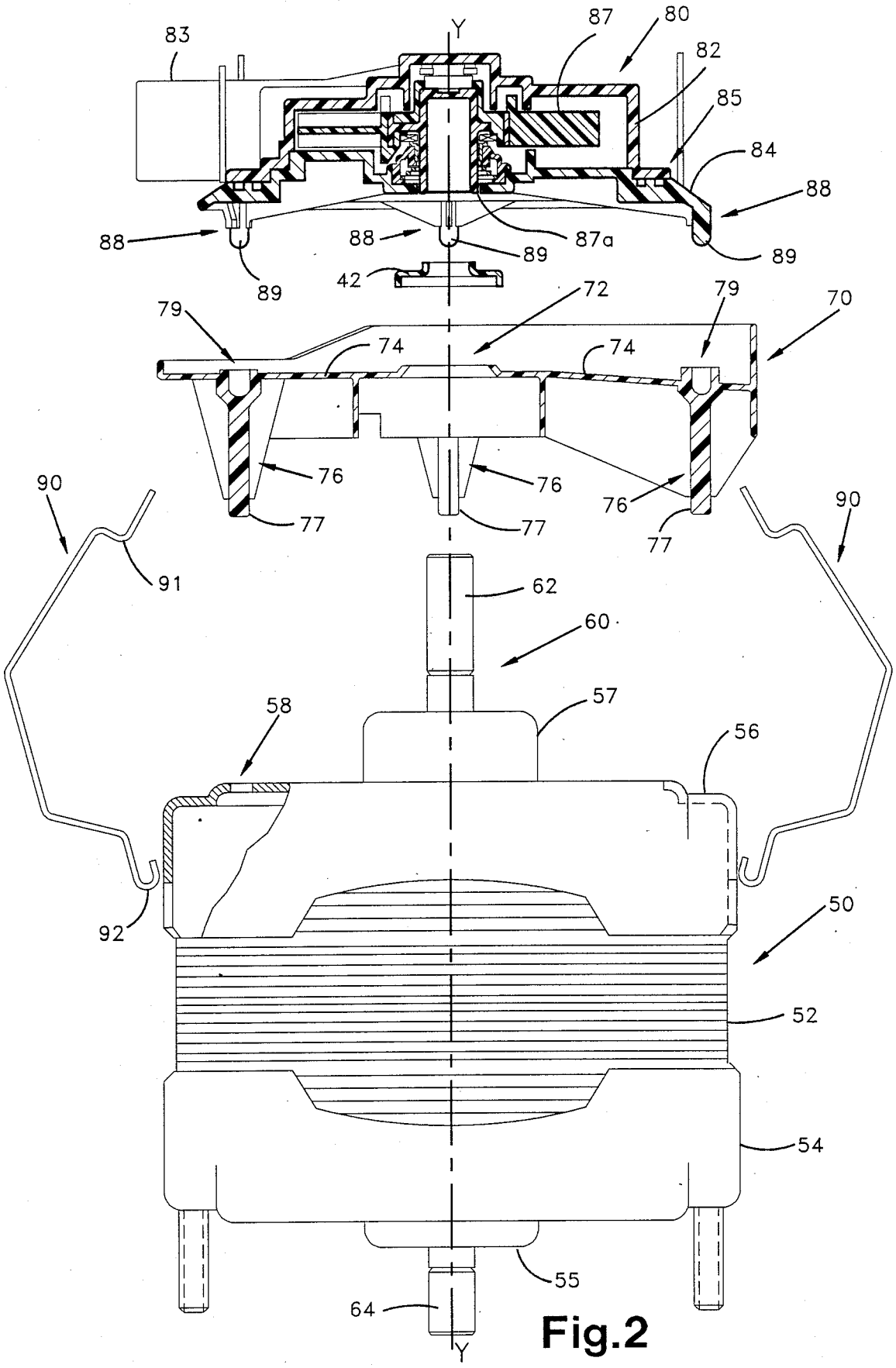
FIG. 2 is an exploded view of a motor-pump assembly in accordance with the present invention with some portions thereof shown in cross section.

Turning to FIG. 2, an exploded view of the motor-pump assembly 40 of FIG. 1 is illustrated. The motor-pump assembly is of the vertical axis type in that the components thereof are aligned along a vertical axis y—y as shown in FIG. 2. An induction-type electric motor 50, generally conventional in design from an electrical standpoint, includes a stator 52 comprised of the usual lamination core or stack which supports a plurality of windings (not shown) about its inner periphery, the stator being tubular in shape so as to surround a rotor (not shown) carried and fixed to an intermediate portion of a vertical drive shaft 60 which has a top end or upper distal end 62 and a bottom end or lower distal end 64. Welded to and extending over the bottom end of the stator 52 is a bottom end bell 54 having a central portion 55 constituting a bearing or bushing structure. In a similar fashion, fixed to the top of the stator 52 and extending over it, is a top end bell 56 which provides at its central portion 57 another bearing or bushing structure as illustrated. As will be recognized by those in the art, the vertical drive shaft 60 is rotatably supported by the end bell central portions 55, 57 so as to freely rotate in either direction on vertical axis y—y in response to energization of the motor 50. It should also be appreciated that end bells 54, 56 in effect cap the upper and lower ends of the stator 52 and include numerous apertures or clearances relative to the stator to permit cooling air to flow through the air gap between the rotor and stator portions of the motor 50. The drive shaft 60 provides the lower distal end 64 which carries and has fixed to it the earlier noted drive pulley 28 (see FIG. 1). The upper distal end 62 of the shaft 60 extends above top end bell 56.

Figure 3:
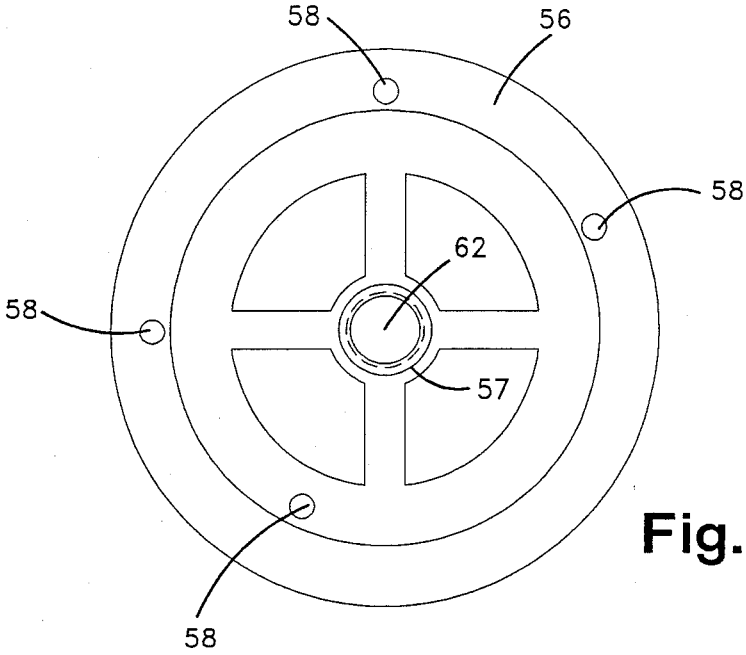
FIG. 3 is a plan view of the top end bell of the motor forming a part of the assembly illustrated in FIG. 2.

With reference to FIG. 3, the top end bell 56 with the top end 62 of the drive shaft extending therefrom can be seen to provide a plurality or first set of locator points in the illustrated form of apertures 58 (also see FIG. 2). These locator points are circumferentially distributed about and radially spaced from the vertical axis y—y. With further reference to FIG. 2, and in accordance with the present invention, a dishlike shield 70 formed, for example, from injection-molded plastic material, is provided immediately above the top end bell 56 of the motor 50. The drip shield 70 includes at its central portion an aperture 72 through which the top end 62 of the shaft 60 can freely extend. The shield 70 further includes an annular water collecting surface 74 that circumferentially extends about the axis y—y. A plurality of downwardly extending leg portions 76 are provided by the drip shield 70, the leg portions 76 having bottom ends or distal ends 77. Located at the top ends of the leg portions 76 are a plurality or second set of locator points constituted by recesses 79.

A further component of the motor-pump assembly of the present invention includes a conventional slinger ring 42 that is formed of rubberlike elastomeric material, the slinger 42 being press-fitted over the top end 62 of the shaft 60.

Figure 4:
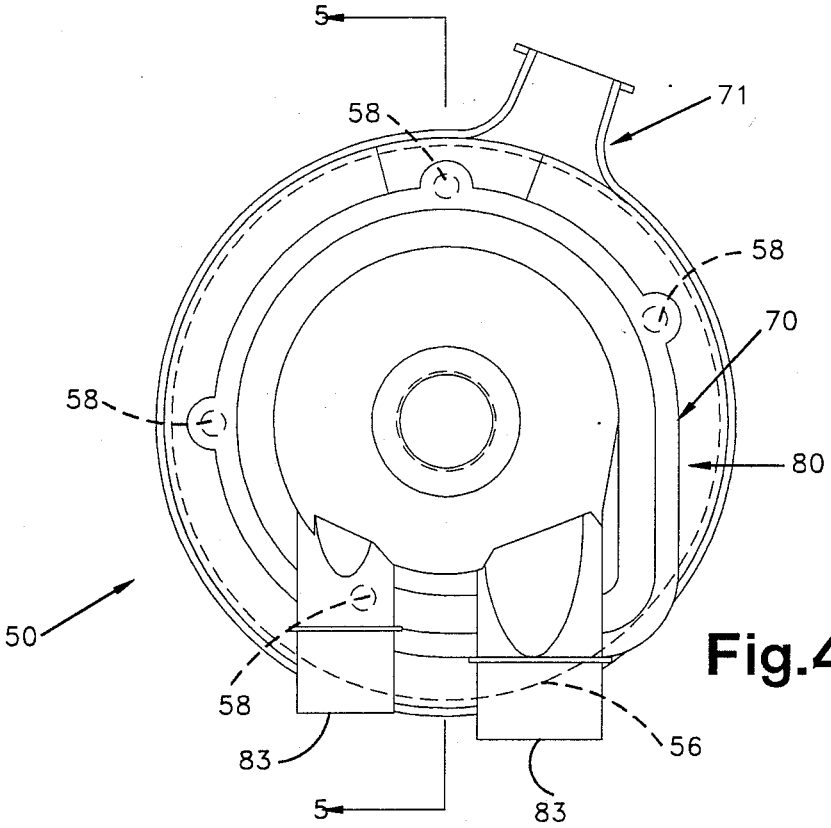
FIG. 4 is a plan view of the top of the motor-pump assembly in accordance with the present invention.

In further accordance with the present invention, a water pump 80 is provided, the water pump 80 being of the disposable type in that its essential components are formed from low cost injection-molded plastic material. The pump 80 includes a casing comprised of a top half 82 and a bottom half 84, the halves 82, 84 being fastened together in a leaktight manner by an ultrasonically-induced weld seam 85. The pump casing halves 82. 84 provide a chamber for containing a rotatable impeller 87 having a central hub 87*a* which slides over and is press-fitted onto the top end 62 of the shaft 60. Appropriate detent means of a conventional type are provided so that the shaft 60 and the impeller 87 are rotatably fixed relative to each other. The water pump 80 includes inlet-outlet ports 83 (also see FIG. 4). In accordance with the invention, the bottom half 84 of the pump casing provides a plurality of downwardly extending leg portions 88 having lower distal ends 89. The motor 50, the drip shield 70, and the pump 80 are held in assembled position relative to each other, as illustrated in FIGS. 4 and 5, by biasing means in the preferred form of a pair of resilient, springlike metal clips 90.

The assembled relationship of the invention elements illustrated in FIG. 2 will now be discussed with regard to FIGS. 4 and 5. In assembling the components of the motor-pump assembly in accordance with the present invention, the drip shield 70 is placed in position on the top end bell 56 of the motor 50 wherein the bottom ends 77 of the drip shield leg portions 76 are inserted into or in effect plugged into the locator points on the end bell constituted by apertures 58 (also see FIGS. 2 and 3). With the bottom end 77 of the drip shield in position as illustrated in FIG. 5, the drip shield is in effect locked in position relative to the top end bell 56. In a similar fashion, the lower ends 89 of the leg portions 88 of pump 80 are inserted into the locator points on the drip shield 70 constituted by the recesses 79. In this fashion, the pump 80 is fixed in position relative to the drip shield 70 and in turn to the top end bell 56. By proper placement of the apertures 58 and the recesses 79, and by controlling the vertical length of the leg portions 76 and 88, proper positioning of the impeller 87 within the associated casing of the water pump 80, i.e., accurate vertical and axial alignment of the end bell 56, the drip shield 70, and the pump 80, are readily provided.

Figure 5:
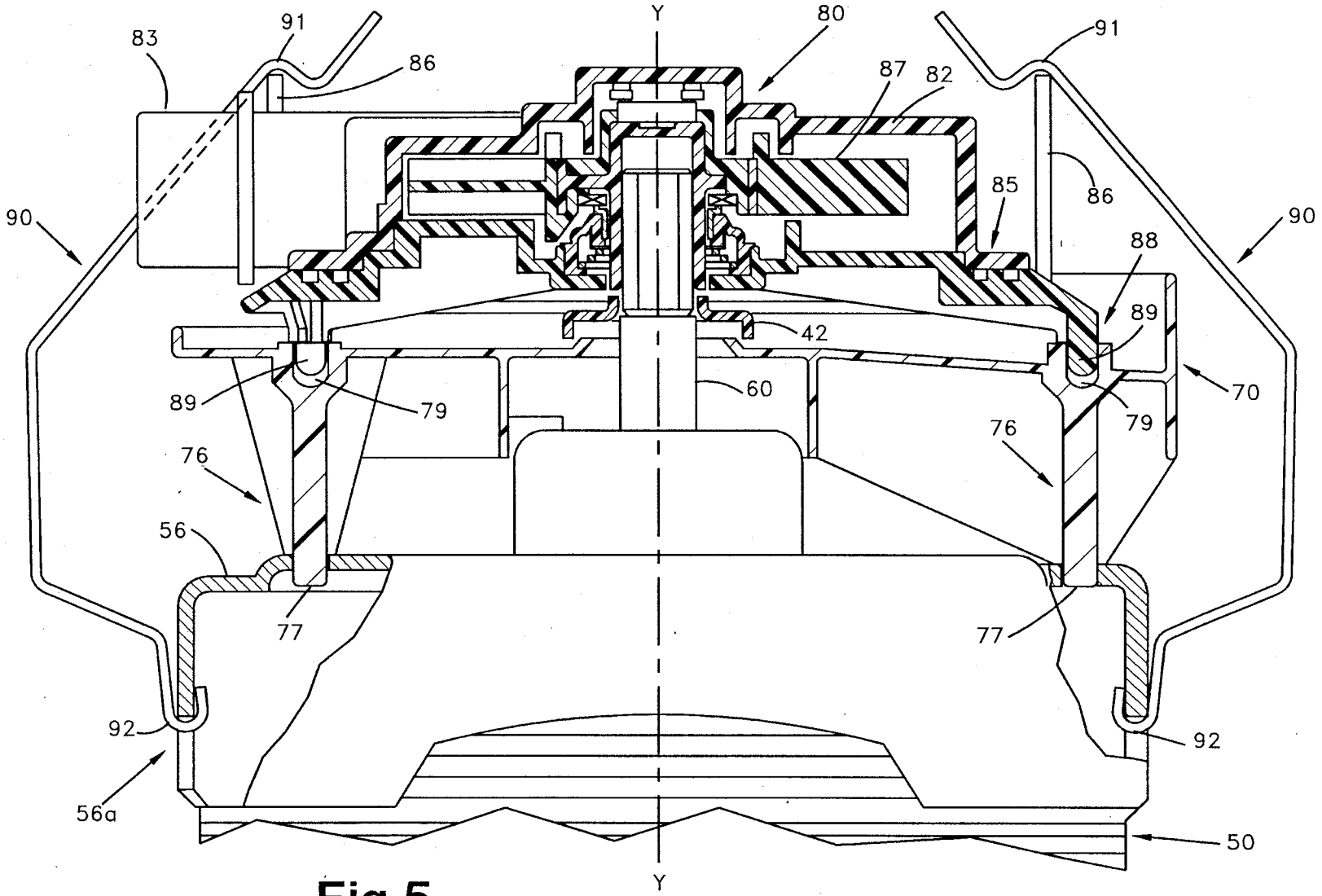
FIG. 5 is a partial cross section view of the motor-pump assembly taken along line 5—5 of FIG. 4, illustrating the components of the motor-pump assembly of FIG. 2 in an assembled configuration.

With particular reference to FIG. 5, it can be seen that any water leaking downwardly from the pump 80 is diverted from the motor 50. More specifically, water leaking downwardly about the upper end 62 of the motor shaft 60 is diverted by the slinger ring 42, while water that might leak from a defect in the ultrasonically-induced weld seam 85 would be caught by the drip shield 70 which has a water diverting spout 71 (see FIG. 4) from which the water would fall vertically outside of the area occupied by the motor 50. As shown in FIG. 5, the biasing means is in the preferred form of a pair of spring steel metal clips 90 holding the pump 80 and the drip shield 70 in position relative to each other and to the end bell 56. The metal clips 90 are generally C-shaped and have at their upper ends indented areas 91 that are received by and ride on top of a pair of stanchions 86 extending upwardly from, and forming an integral portion of, the upper casing 82 of the pump 80. The lower ends of the clips 90 provide hook portions 92 which clip under bottom edge portions **56*a* of the top end bell 56. The two clips 90** are radially spaced from axis y—y and are diametrically opposed, as illustrated.

As noted earlier, the leg portions 76, 88 of the drip shield 70 and pump 80 are sized to space pump 80 a predetermined distance from the top end bell 56. It can also be seen from the foregoing description and drawings that the leg portions 76 of the drip shield 70 and the leg portions 88 of the casing of the pump 80 are vertically aligned with each other to concentrate the biasing force of spring clips 90 at the locator points on the drip shield 70 and the end bell 56 as discussed earlier.

Replacement of the pump 80, which is as noted earlier of the disposable type can be easily effected by manually snapping off the clips 90 wherein the pump 80 can be pulled off the top of the shaft 60. It is also then possible to remove the drip shield 70 to permit access to the underlying end bell 56 so that dust and other accumulated dirt can be removed. Reassembly of the motor-pump assembly as illustrated in FIG. 5 is once again effected by mounting the drip shield 70, and then mounting on top of it a new pump 80 which is pressed onto the top of the shaft 60. With the pump 80 fixed in position on the drip shield 70, and the drip shield 70 fixed in position on the end bell 56, the spring clips 90 are snapped into the position best illustrated in FIG. 5 to once again provide a downward biasing force on the pump 80 and drip shield 70.

Although the preferred embodiment of this invention has been shown and described, it should be understood that various modifications and rearrangements of the parts may be resorted to without departing from the scope of the invention as disclosed and claimed herein.

What is claimed is:

1. A motor-pump assembly for a clothes washing machine comprising:

a motor with a casing having a top end bell and a bottom end bell, said motor including a generally vertical drive shaft rotatably supported by said end bells, the upper end of said shaft extending above said top end bell;

a dishlike drip shield having a plurality of downwardly extending leg portions with distal ends that engage the said top end bell, said top end bell supporting said drip shield, said drip shield including a generally centrally located aperture through which the upper end of said drive shaft freely extends;

a water pump positioned above said drip shield, said pump having a pump casing defining a chamber enclosing a rotatable impeller, the upper distal end of said drive shaft carrying and rotatably driving said rotatable impeller, said impeller being fitted over the said upper distal end of said drive shaft so that it can be removed from said drive shaft by manually moving said pump away from said drip shield, said pump casing including another plurality of downwardly extending leg portions with distal ends that engage said drip shield, said drip shield supporting said pump casing, said drip shield diverting away from said motor any water that may leak downwardly from said pump; and means for applying a biasing force to said pump casing to hold it in position against said drip shield, said biased pump casing in turn applying a biasing force against said drip shield to hold it in position against said top end bell of said motor.

2. A motor-pump assembly according to claim 1, wherein said means for providing a biasing force comprises two springlike clips extending between said top end bell and said pump casing, said clips being manually removable to permit disassembly of said pump and drip shield from each other and top end bell so that said pump can be replaced with another generally identical pump.

3. A motor-pump assembly according to claim 1, wherein said leg portions of said drip shield and said leg portions of said pump casing are sized to space said pump casing a predetermined distance from said top end bell.

4. A motor-pump assembly according to claim 1, wherein said leg portions of said drip shield and said leg portions of said pump casing are vertically aligned with each other.

5. A motor-pump assembly for a clothes washing machine comprising:

a motor with a casing having a top end bell and a bottom end bell, said motor including a generally vertical drive shaft rotatably supported by said end bells, the upper end of said shaft extending above said top end bell, said top end bell providing a plurality of locator points radially spaced from and distributed about said vertical drive shaft;

a dishlike drip shield having a plurality of downwardly extending leg portions with distal ends that engage said locator points on said top end bell, said drip shield being maintained at a fixed position relative to said top end bell by said locator points, said drip shield including a generally centrally located aperture through which the upper end of said drive shaft freely extends, said drip shield providing another plurality of locator points radially spaced from and distributed about said vertical drive shaft;

a water pump having a pump casing defining a chamber enclosing a rotatable impeller, the upper distal end of said drive shaft carrying and rotatably driving said rotatable impeller, said leg portions of said drip shield and said leg portions of said pump casing being vertically aligned with each other, said pump casing including another plurality of downwardly extending leg portions with distal ends that engage said another plurality of locator points on said drip shield, said drip shield supporting said pump casing, said pump casing being maintained at a fixed position relative to said drip shield by said another plurality of locator points, said drip shield diverting away from said motor any water that may leak downwardly from said pump; and springlike clip means extending between said top end bell and said pump casing, said clip means applying a biasing force against said pump casing to hold said pump casing, drip shield, and top end bell in position relative to each other, said drip shield, in effect, being sandwiched between said pump casing and said top end bell of said motor.

6. A motor-pump assembly according to claim 5, wherein said locator points on said top end bell are constituted by a plurality of apertures in said end bell, said distal ends of said leg portions extending downwardly from said drip shield being received by and inserted into said apertures constituting said locator portions on said top end bell.

7. A motor-pump assembly according to claim 5, wherein said locator points on said drip shield are constituted by a plurality of recesses in said drip shield, said distal ends of said leg portions extending downwardly from said pump casing being received by and inserted into said recesses constituting said locator points on said drip shield.

8. A motor-pump assembly according to claim 5, wherein said clip means is constituted by two metal clips, said clips being radially spaced from the vertical axis of said drive shaft, said clips being generally diametrically opposed to each other relative to said vertical axis.

9. A motor-pump assembly according to claim 5, wherein said clip means are manually removable, said clip means being the sole means for holding said pump and said drip shield in position relative to each other, and relative to said top end bell of said motor.

* * * * *